US005131958A

United States Patent [19]

Sakai et al.

[11] Patent Number: 5,131,958

[45] Date of Patent: Jul. 21, 1992

[54] METHOD OF HOT FORMING BERYLLIUM-COPPER ALLOY AND HOT FORMED PRODUCT THEREOF

[75] Inventors: Taku Sakai, Chofu; Takaharu Iwadachi; Naokuni Muramatsu, both of Handa, all of Japan

[73] Assignee: NGK Insulators, Ltd., Japan

[21] Appl. No.: 493,769

[22] Filed: Mar. 15, 1990

[30] Foreign Application Priority Data

Mar. 15, 1989 [JP] Japan ..... 1-62714

[51] Int. Cl.[5] ..... C22F 1/08

[52] U.S. Cl. ..... 148/680; 148/432; 420/469; 420/494; 420/496

[58] Field of Search ..... 148/11.5 C, 432; 420/469, 494, 496

[56] References Cited

U.S. PATENT DOCUMENTS

| | | | |
|---|---|---|---|
| 2,257,708 | 9/1941 | Stott | 148/12.7 CX |
| 2,266,056 | 12/1941 | Martin | 148/12.7 R |
| 2,266,056 | 12/1941 | Martin | 148/12.7 R |
| 3,234,052 | 2/1966 | Wikle | 148/2 |
| 4,425,168 | 1/1984 | Goldstein et al. | 148/2 |

FOREIGN PATENT DOCUMENTS 621224 4/1949 United Kingdom .

OTHER PUBLICATIONS

Metals Handbook, "Properties and Selection-Nonferrous Alloys and Pure Metals", vol. 2; 9th Edition, p. 303.

"Beryllium Copper", E. Voce, First Edition, 1958, pp. 30-52, Copper Development Asso., London, GB; The Manufacture and Manipulation of Berryllium Copper.

"Properties and Applications of Cast Coppers and Copper Alloys", Metal Progress, vol. 102, No. 3, Sep. 1972, pp. 70-71.

JP-A-59-38367, Patent Abstracts of Japan, vol. 8, No. 126, Jun. 13, 1984, Sumitomo Denki Kogyo K.K.) Feb. 3, 1984.

"Recovery and Recrystallization of Polycrystalline Copper After Hot Working", Petkovic, et al., Acta Metallurgica, vol. 27, No. 10, Oct. 1974, pp. 1633-1648.

"Initiating Nucleatin of Dynamic Recrystallization, Primarily in Polycrystals", McQueen, Materials Science & Engineering A, vol. 101, May 1988, pp. 149-160.

*Primary Examiner*—R. Dean
*Assistant Examiner*—Sikyin Ip
*Attorney, Agent, or Firm*—Parkhurst, Wendel & Rossi

[57] ABSTRACT

A method of hot forming beryllium-copper alloy including from 1.60 to 2.00% by weight of Be, from 0.2 to 0.35% by weight of Co and the balance being essentially Cu, under specified conditions of a working temperature, a working rate, and an amount of work strain to produce a hot formed product of an equiaxed grain structure having a uniform stable grain size.

2 Claims, 3 Drawing Sheets

| Working Rate ($S^{-1}$) | Working Temperature (°C) | | | | |
|---|---|---|---|---|---|
| | <600 | 750 | 800 | 850 | 860< |
| $<3.3 \times 10^{-5}$ | A | | B | | C |
| $3.3 \times 10^{-5}$ | | | D | | |
| $3.3 \times 10^{-3}$ | | | | | |
| $2.5 \times 10^{-1}$ | | | | | |
| 10< | | | | | |

Grain Structure

| Before Working | After Working | |
|---|---|---|
|  | A |  |
| | B |  |
| | C | Melt |
| | D |  |

METHOD OF HOT FORMING BERYLLIUM-COPPER ALLOY AND HOT FORMED PRODUCT THEREOF

BACKGROUND OF THE INVENTION

1. Field of the Invention

The present invention relates to a method of hot forming beryllium-copper alloy having excellent mechanical strength and reliability and the hot formed product thereof.

2. Related Art Statement

Various beryllium-copper alloys mainly consisting of beryllium and copper have widely been used as high tensile spring materials, electrical conductive materials and the like.

Such a beryllium-copper alloy is worked mostly by hot forming, but deforming mechanisms of beryllium-copper alloy during hot working have not been clarified and in many cases the working conditions for beryllium-copper alloy have been determined only experimentally. Consequently, there are problems that cracks occur during hot working and the grains formed in hot formed articles are coarse and nonuniform and as a result, the strength and the reliability of the articles are not sufficient.

SUMMARY OF THE INVENTION

It is an object of the present invention to overcome the aforementioned problems and to provide a method of hot forming beryllium-copper alloy having excellent reliability by clarifying the behavior of beryllium-copper alloy during hot forming to determine preferred working conditions for preventing cracks and nonuniform grains from occurring during hot working.

It is another object of the present invention to provide a hot formed product of beryllium-copper alloy having excellent mechanical strength and reliability.

According to a first aspect of the present invention, there is a provision of a method of hot forming beryllium-copper alloy consisting essentially of from 1.60 to 2.00% by weight of Be, from 0.2 to 0.35% by weight of Co, and the balance essentially being Cu, under specified conditions of a working temperature in a range of 600~860° C., a working rate in a range of $3.3\times10^{-5}\sim10\ S^{-1}$ and an amount of work strain of at least 0.20.

According to a second aspect of the present invention, a hot formed product of beryllium-copper alloy comprising from 1.60 to 2.00% by weight of Be, from 0.2 to 0.35% by weight of Co and the balance essentially being Cu, has an equiaxed grain structure having a uniform stable grain size which is obtained by dynamic recrystallization.

As mentioned above, according to the present invention, an available beryllium-copper alloy having a conventional composition is hot formed under a combination of the aforementioned specified conditions of the working temperature, working rate and amount of work strain to cause dynamic recrystallization and thereby obtain beryllium-copper alloy of an equiaxed grain structure having a uniform stable grain size. The hot forming is preferably carried out in such a range that the grain size is not varied and a stable grain size is obtained even if the amount of work strain is increased.

The dynamic recrystallization mentioned above means a phenomenon that a new grain structure grows as the deformation progresses during hot working beyond a yield point and such a phenomenon is well known in certain pure metals, but is not confirmed in alloys consisting of multiple components such as beryllium-copper alloy.

The inventors have made various experiments by hot forming beryllium-copper alloy under a variety of working conditions and found specified working conditions for ensuring the formation of dynamic recrystallization in beryllium-copper alloy. When beryllium copper alloy is worked under such specified working conditions, an equiaxed grain structure having a uniform stable grain size, which is different from a deformed grain structure caused by working of statically recrystallized grain structure can be fabricated to provide a hot formed product having excellent mechanical strength and reliability without the occurrence of cracks during hot forming.

The reasons why each of the specified conditions according to the present invention is limited will be now described.

The reason why the beryllium-copper alloy comprising from 1.60 to 2.00% by weight of Be, from 0.2 to 0.35% by weight of Co and the balance being essentially Cu is selected is that the composition is most industrially utilizable in view of the mechanical strength, electrical conductivity and economics.

The reason why the working temperature of 600~860° C. is selected is that if it is lower than 600° C., the dynamic recrystallization does not appear and the grain structure before hot working is only worked, so that the purpose of the present invention can not be attained by the hot working. While, if the working temperature is higher than 860° C., the product is molten.

The reason why the working rate is limited in a range of $3.3\times10^{-5}\sim10\ S^{-1}$ is that if it is lower than $3.3\times10^{-5}\ S^{-1}$, the productively is low and impractical and the dynamic recrystallized grain becomes coarse, while if the working rate is higher than $10\ S^{-1}$, there is no time for dynamically recrystallizing and the alloy is only worked. It is noted that the working rate means an amount of deformation per one second divided by the original dimension, that is expressed by strain/second.

Furthermore, the reason why the amount of work strain is at least 0.20 is that if it is less than 0.20, the dynamic recrystallization does not appear and leave the grain structure which exists before hot working.

The invention will now be described in more detail, by way of example, with reference to the accompanying drawings.

BRIEF DESCRIPTION OF THE ATTACHED DRAWINGS

DESCRIPTION OF THE PREFERRED EMBODIMENTS

In order to confirm the specified working conditions for forming a homogeneous fine equiaxed structure, various experiments were carried out as mentioned below.

Test pieces each having shouldered end portions and a parallel middle portion of 12 mm length and 3 mm width were prepared by longitudinally cutting a beryllium-copper alloy cold strip of 0.5 mm thickness having a chemical composition consisting of Be: 1.80 wt%, Co: 0.25 wt% and the balance being Cu. These test pieces were annealed to form various initial grain sizes in a range of 31 ~ 83 μm. A high temperature tensile test was carried out for each test piece by using a high temperature tensile-quick cooling test machine, in which each test piece was heated and held for twenty minutes at 860° C. in a vacuum atmosphere and then cooled to an individual predetermined test temperature in the vacuum furnace and held for ten minutes. After deforming, the hot deformed structure which is frozen under hydrogen gas quick cooling was observed by an optical microscope. Thus, the specified working conditions for forming a homogeneous fine equiaxed grain structure were confirmed.

Figure 1:
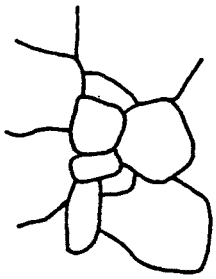
FIG. 1 is a diagram illustrating effects of working temperature and working rate on grain structure when a work strain of at least 0.20 is applied.
Figure 1:
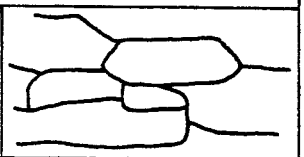
Figure 1:
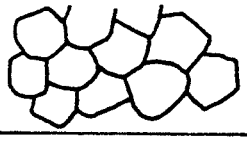
Figure 1:
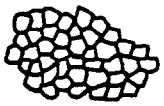

FIG. 1 is a diagram illustrating the effects of working temperature and working rate on the grain structure when the amount of work strain is not less than 0.20. In condition "A", that is when the working temperature is lower than 600° C. or the working rate is higher than 10 $S^{-1}$, the structure is deformed to change to only an elongated grain structure. In condition "B", that is when the working rate is lower than $3.3\times10^{-5}S^{-1}$, the grain structure becomes homogeneous, but is coarse and such a working rate is too low to practically use. In condition "C", that is when the working temperature is higher than 860° C., the material melts. While, in the condition "D" according to the present invention, a homogeneous fine equiaxed grain structure can be reasonably obtained. The beryllium-copper alloy having the equiaxed grain structure obtained under the condition "D" has excellent mechanical strength and reliability. Moreover, cracks do not occur under the condition "D".

Figure 2:
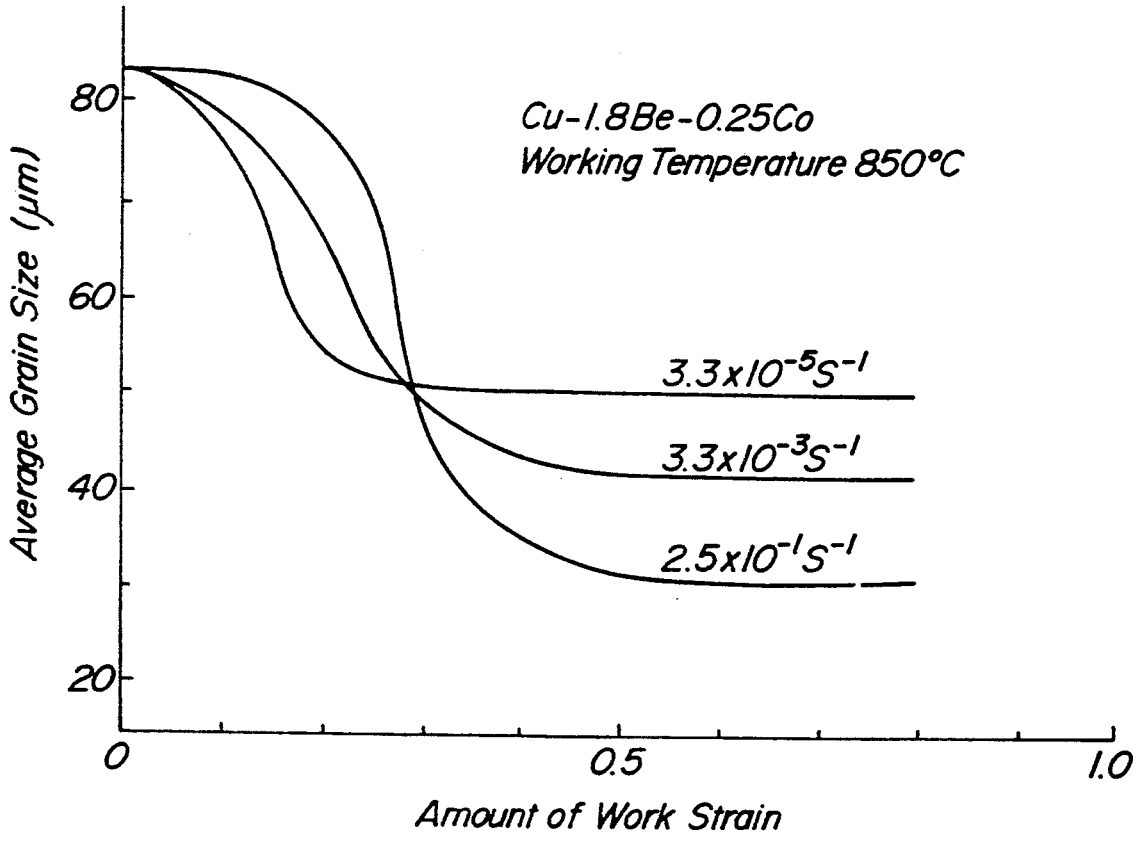
FIG. 2 is a graph showing variation of average grain size with working as well as influence of working rate thereon.

It is noted that FIG. 2, is a graph showing a variation of the average grain size with working and influence of the working rate on the average grain size. It will be seen from the graph that when the amount of working strain is not less than 0.20, stable fine equiaxed grains having a grain size of not more than 50 μm can be obtained corresponding to the working rate.

Figure 3:
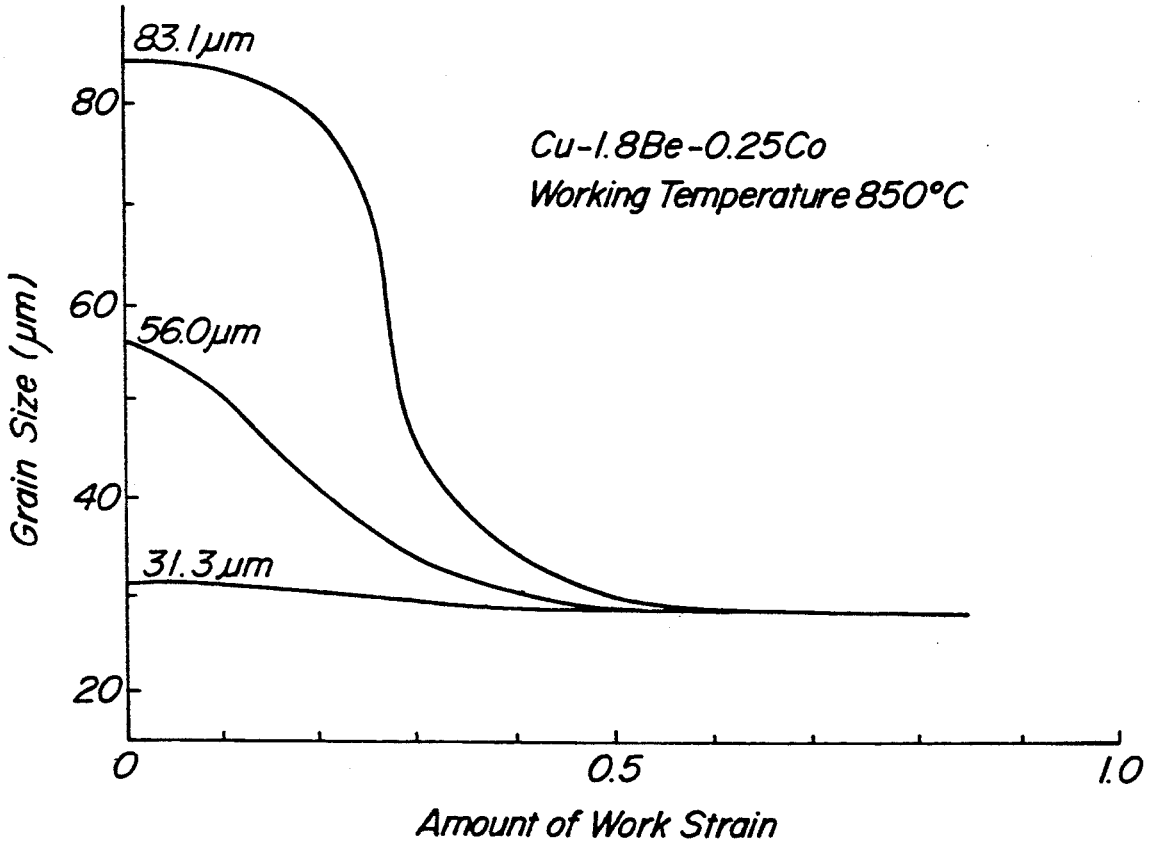
FIG. 3 is a graph showing variation of initial grain size with working.

Furthermore, FIG. 3 is a graph showing variation of grain size from initial grain size with working. It will be seen from the graph that the grain size of deformed structure in high strain zone is uniform and stable, independent of the initial grain size. Accordingly, in the present invention it is preferable to effect the hot working until the high strain zone in which even if the amount of working strain is increased the grain size does not change as shown by a horizontal line in the graph to provide uniform stable grain size.

It will be understood from the above description, according to the present invention deformability and formability of beryllium-copper alloy at a high temperature is greatly improved, and a homogeneous fine equiaxed grain structure can be obtained to improve the mechanical strength and reliability of hot worked products.

What is claimed is:

1. A method of hot forming beryllium-copper alloy consisting essentially of from 1.60 to 2.00% by weight of Be, from 0.2 to 0.35 % by weight of Co and the balance being essentially Cu, said method comprising the steps of hot working the beryllium-copper alloy at a working temperature in a range of 600-860° C., a working rate in a range of $3.5\times10^{-5}$ — $10S^{-1}$, and an amount of work strain in a range of 0.2 to about 1.0 and then quenching, whereby an equiaxed grain structure with a uniform stable grain size is maintained in said alloy independent of said work strain employed within said range of 0.2 to about 1.0.

2. A hot formed product of beryllium-copper alloy having a composition comprising from 1.60 to 2.00% by weight of Be, from 0.2 to 0.35% by weight of Co and the balance being essentially Cu, said product having an equiaxed grain structure with a uniform stable grain size of not more than about 50 μm, said equiaxed grain structure and said uniform stable grain size being obtained by dynamic recrystallization by hot working the beryllium-copper alloy at a working temperature in a range of 600 - 860° C., a working rate in a range of $3.5\times10^{-5}$ - $10S^{-1}$, and an amount of work strain in a range of 0.2 - 1.0 and then quenching.

* * * * *